United States Patent [19]

Boyadjian

[11] Patent Number: 5,042,343

[45] Date of Patent: Aug. 27, 1991

[54] DEVICE AND MACHINE FOR CUTTING WIRE BINDING PORTIONS

[76] Inventor: Hratch Boyadjian, Obstgartenstrasse 8, 8703 Erlenbach, Switzerland

[21] Appl. No.: 286,954

[22] PCT Filed: Jan. 11, 1988

[86] PCT No.: PCT/CH88/00006

§ 371 Date: Oct. 26, 1988

§ 102(e) Date: Oct. 26, 1988

[87] PCT Pub. No.: WO88/06533

PCT Pub. Date: Sep. 7, 1988

[30] Foreign Application Priority Data

Feb. 27, 1987 [CH] Switzerland ..... 763/87

[51] Int. Cl.[5] ..... B42B 5/10

[52] U.S. Cl. ..... 83/208; 83/210; 83/276; 83/369; 140/105; 281/27.3; 412/39

[58] Field of Search ..... 83/152, 159, 210, 280, 83/282, 208, 369, 276; 140/105; 198/817; 281/27.2, 27.3; 412/39

[56] References Cited

U.S. PATENT DOCUMENTS

| | | | |
|---|---|---|---|
| 3,177,749 | 4/1965 | Best et al. | 83/649 |
| 3,334,918 | 8/1967 | Pigna et al. | 412/39 |
| 3,796,117 | 3/1974 | Mukai et al. | 83/210 |

FOREIGN PATENT DOCUMENTS

| | | |
|---|---|---|
| 0041249 | 12/1981 | European Pat. Off. . |
| 2110611 | 6/1972 | France . |
| 2096538 | 10/1982 | United Kingdom . |

*Primary Examiner*—Hien H. Phan

[57] ABSTRACT

A device for automatic separation of wire binding portions of random length and shape. From a delivery spool a wire strand is fed into a feed mechanism behind which is arranged a cutting mechanism. A sensor measures the length of the wire binding portion and consequently initiates the cutting process via a processor. A further sensor establishes the discharge of the separated wire binding portion.

9 Claims, 2 Drawing Sheets

DEVICE AND MACHINE FOR CUTTING WIRE BINDING PORTIONS

BACKGROUND OF THE INVENTION

The present invention relates to a device for cutting a wire binding portion for binding a pack of sheets in which, over a casing, is rotatably mounted a delivery spool with an endless wire strand shaped into a wire binding, particularly a wire comb binding; Measuring, sensing and cutting means are provided in the device for separating wire binding portions of given length from the wire strand.

Numerous different constructions are known of devices for cutting wire binding portions, such as are used for binding packs of loose sheets. This involves threading a binding portion produced from wire through a row of holes in the loose sheets in such a way that the sheet pack is reliably held together. It is important that the wire binding portion has precisely the length of the pack and consequently does not project at the edges to avoid getting caught or causing injury.

In the simplest construction such devices comprise a manually or motordriven feed wheel and a cutting mechanism, which separates the wire binding portions in the desired length from a wire shaped into a binding and which is unwound as an endless wire strand from a spool.

In another known device of this type it is admittedly possible to process wire bindings of different wire thickness, different pitch and different diameter, but is is necessary for this to replace in each case one or more parts, e.g. the feed wheel, with parts which are necessary for the particular wire binding. However, this involves additional expenditure and effort. In view of the replacement parts, the number of processed wire bindings is limited.

SUMMARY OF THE INVENTION

It is an object of the present invention to provide a device of the aforementioned type which makes it possible to process wire bindings of random size, pitch and wire thickness.

According to the invention this and other objects of the invention are attained by a device comprising a feed mechanism including an envelope drive having an envelope member which is in contact with the wire strand guided on a running path and moves therewith. A further object of the present invention is to enable the device to operate fully automatically, in which only the desired number of wire binding portions and of desired length thereof are fed into the device and then the manufacture thereof takes place automatically.

The aforementioned objects, features and advantages of the invention will, in part, be pointed out with particularity, and will, in part, become obvious from the following more detailed description of the invention. taken in conjunction with the accompanying drawing, which form an integral part thereof.

DETAILED DESCRIPTION OF THE PREFERRED EMBODIMENTS

Figure 1:
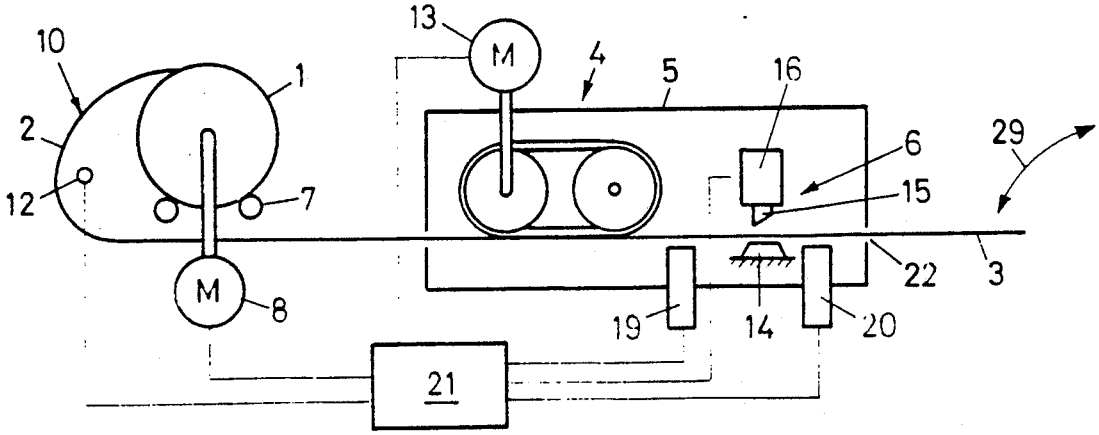
FIG. 1 is a diagrammatic representation of a device for cutting wire binding portions, in which the individual parts of the device are drawn apart.

In the device for the cutting of wire binding portions diagrammatically represented in FIG. 1, 1 is a delivery spool from which is unwound a wire strand 2 shaped as a wire binding and is supplied to a feed mechanism 4, which is housed in a casing 5. Casing 5 also contains a cutting mechanism 6, which separates the desired wire binding portions 3 from wire strand 2.

The delivery spool 1 is rotatably mounted on rollers 7 and is driven by a motor 8. On unwinding the wire strand 2 from the delivery spool 1 a loop 10 is formed, which is controlled by a sensor 12. If the loop 10 is smaller and passes over the sensor 12, motor 8 is put into operation and unwinds wire from the delivery spool 1 until the loop 10 again has its desired size. It is also conceivable to drive the rollers 7, which would facilitate the changing of the delivery spool 1.

The feed mechanism 4 is driven by a further motor 13. The cutting mechanism 6 essentially comprises a fixed cavity block 14 and a movable cutting edge 15, which is operated by a drive, e.g. an electromagnet 16. Two further sensors 19, 20 are installed in casing 5 in the vicinity of the running path of wire strand 2. Sensor 19 measures the length of the wire binding portion, i.e. it counts the individual wire bindings and transmits corresponding signals to a processor 21, which ensures an exact stoppage of the feed mechanism 4 and operates the cutting mechanism 6 on reaching the set binding number. The sensor 20 monitors the discharge of the separated wire binding portions 3 and gives the signal for initiating the next step if the separated portion 3 is no longer scanned by the sensor 20. The separated wire binding portion 3 is removed either manually, via a conveyor belt or by a handling means and is supplied for further processing. This operation is merely indicated by the double arrow 29 in FIG. 1.

Figure 2:
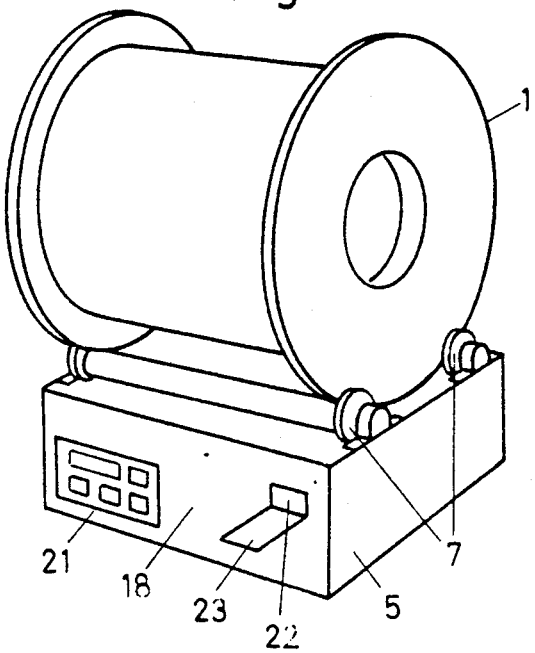
FIG. 2 is a perspective view of the device according to FIG. 1.

The device shown in FIG. 2 corresponds to the solution shown in FIG. 1. The delivery spool 1 is mounted in rotary manner on rollers 7 and the latter are driven by the motor 8 located in the interior of the casing. On the end face 18 of casing 5 is arranged the processor 21 or its instrument panel. On end face 18 is also provided an opening 22 for the discharge of the separated wire binding portions and a rail 23 from which the separated wire binding portion 3 can be removed.

Figure 3:
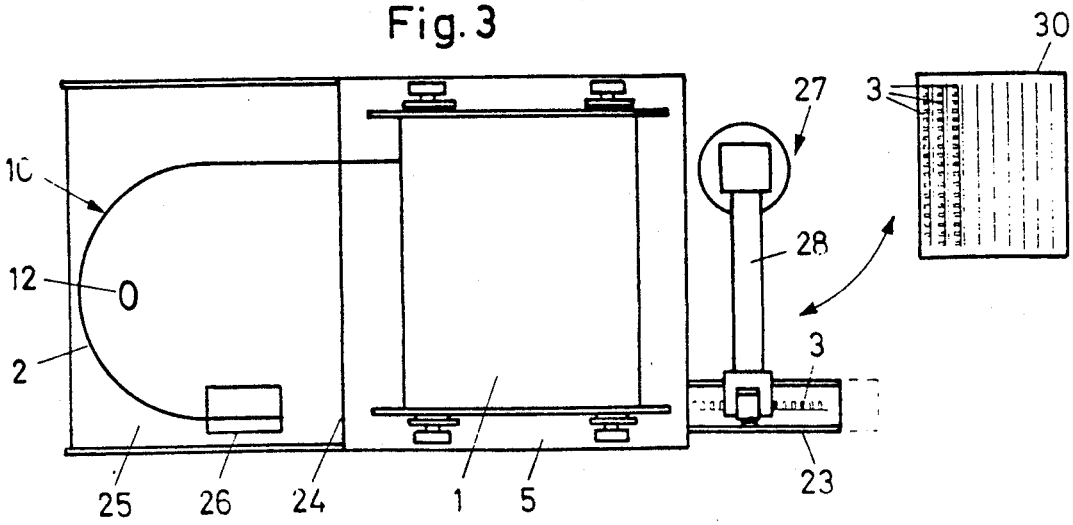
FIG. 3 is a top plan view of the device according to FIG. 2.

The plan view of FIG. 3 reveals the loop of wire strand 2 on the back 24 of casing 5 and which has been unwound from the delivery spool 1. Through an opening 26 in plate 5 strand 2 on the back of casing 5 passes into the feed mechanism 4, which will be described in detail in connection to FIGS. 4 and 5.

It is possible to see on the end face 18 of casing 5 the rail 23, whose extraction length is adjustable, with a wire binding portion 3 resting thereon. The wire binding portion 3 is grasped by a handling means 27, which has a gripper arm 28. Gripper arm 28 is pivoted to a substrate 30 on which the individual wire binding portions are deposited in separated manner. The deposition of the wire binding portions 3 takes place automatically and either gripper arm 28 is extendable or substrate 30 is displaceable, so that the wire binding portions 3 can be separately deposited. However, the device can also operate satisfactorily without using a handling means 27.

Figure 4:
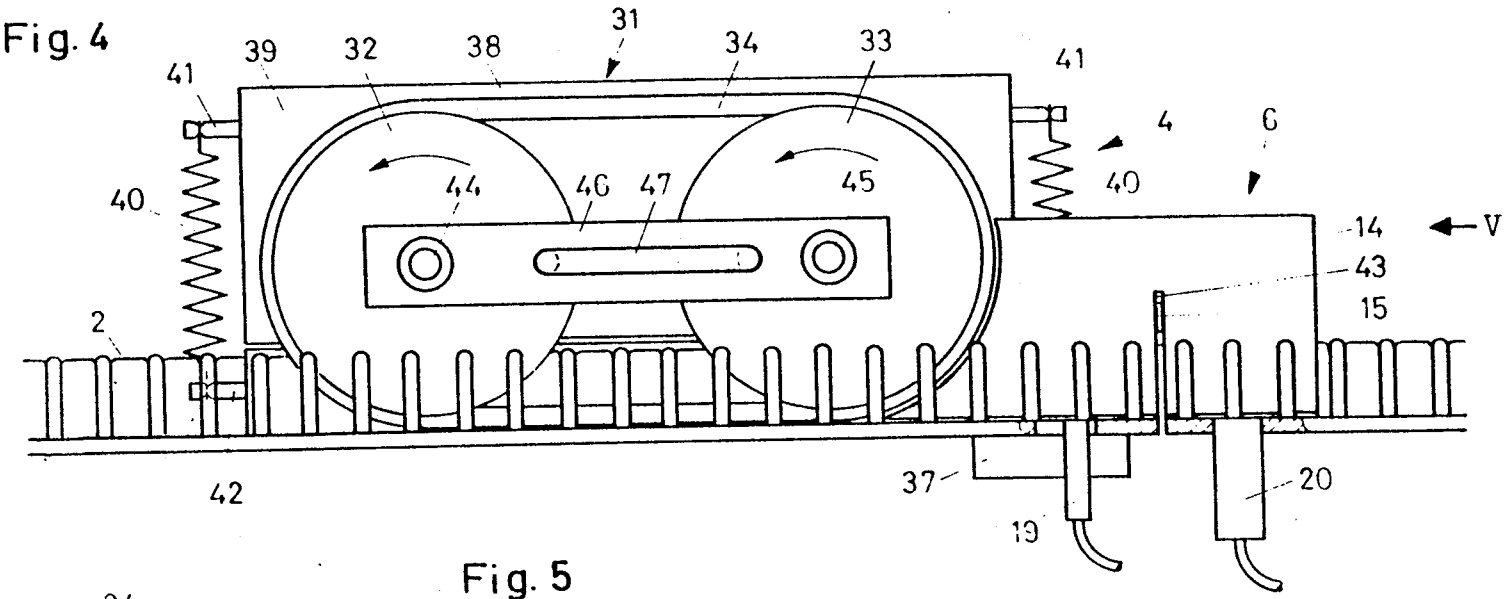
FIG. 4 is a side view of the feed mechanism.

The feed mechanism 4 shown in FIG. 4 has an envelope drive 31, which comprises a wheel 32 driven by motor 13, a jointly rotating wheel 33 and an envelope member 34 connecting two wheels 32, 33 to each other. As can be gathered from FIG. 5, the envelope drive 34 is constructed as a twin belt drive with two juxtaposed belt drives 35, 36, whose spacing can be adjusted and therefore adapted to different wire binding sizes, cf. FIG. 5.

The wire strand 2 entering the feed mechanism passes through under two belt drives 35, 36. The envelope members 34 are elastic profile belts, e.g. with a circular profile, whose back surface is pressed onto the inside of the binding of strand 2. In the case of movement on envelope drive 31, strand 2 is also moved by friction grip.

In order to ensure that an adequate pressure is exerted on wire strand 2 by two envelope members 34, the envelope drive 31 is mounted in a bearing body 38 movable at right angles to the movement direction of strand 2. The bearing body 38 moves in a fixed frame and is pressed by tension spring 40 against wire strand 2. The tension springs 40, on the one hand, engage on arms 41 inseted in bearing body 38 and, on the other hand, on further arms 42 fixed in frame 39.

On outlet side of feed mechanism 4 it is possible to see the two sensors 19, 20, sensor 19 being made longitudinally displaceable through a slide 42. This setting ensures that separation always takes place in the center of a binding. Between two sensors 19, 20 is arranged the cutting mechanism 6, whose fixedly cavity block 14 is visible. Cavity block 14 has a slit 43 through which passes the movable cutting edge 15 on separating a wire binding portion.

Figure 5:
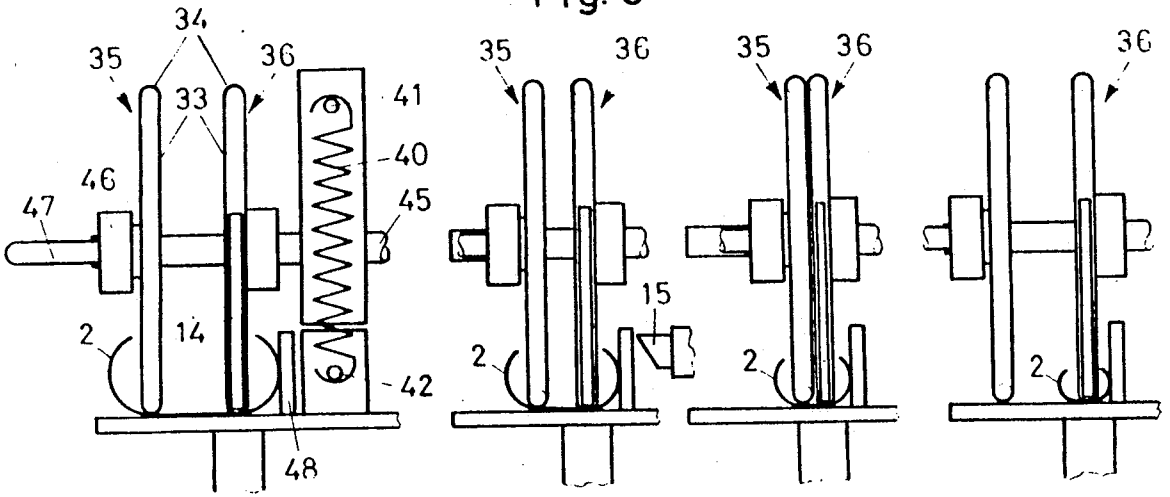
FIG. 5 illustrates a front view of the feed mechanism according to FIG. 4 from direction V in FIG. 4.
Figure 6:
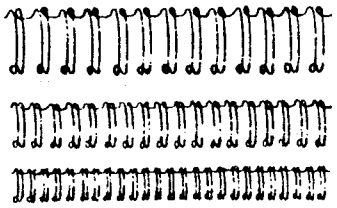
FIG. 6 shows three diagrammatically represented examples of different wire comb bindings.

Corresponding to two wheels 32, 33, the envelope drive 31 has two shafts 44, 45, which are, on the one hand, mounted in the bearing body 38 and, on the other hand, are connected by a crossmember 46 provided wit a handle 47. One of two belt drives 35, 36 can be moved by handle 47, so that the spacing between the two belt drives can be adjusted. It is possible to provide locking settings corresponding to a number of standard sizes. FIG. 5 shows four examples as to how the two belt drives 35, 36 can be adapted to the particularly binding shape. In the case of a large binding, cf. the arrangement to the left in FIG. 5, the spacing is at a maximum. The spacing between the two belts drives 35, 36 decreases as the binding becomes smaller. Even if the binding is very small, cf. the arrangement to the right in FIG. 5, working is still possible, but on this occasion with only a single belt drive 36. FIG. 6 shows as examples three comb bindings from a larger number of obtainable binding sizes and which can all be worked without difficulty in the described device.

For the stationary operation of the described device it is necessary to precisely guide the wire strand 2 in the feed mechanism 4, so that there is a reliable separation of the wire binding portions 3. This is brought about, on the one hand, by the adjustability of the two belts 35, 36 and, on the other hand, by a guide rail 48, which is displaceable at right angles to the movement direction of wire strand 2, so that the latter can be guided in clearance-free manner between the cavity block 14 and the guide rail 48. This is necessary in view of the relatively large force which must be exerted by the movable cutting edge 15. In addition, the cutting edge 15 can be constructed in such a way that there is not only a separating cut with respect to the wire, but also so as to enable a portion of given length to be cut out of the wire. This facilitates the establishment of the discharge of a wire binding portion by the sensor 20.

The described device has a relatively simple construction. Nevertheless, it, on the one hand, permits the processing of wire bindings independently of their size, pitch and wire diameter and, on the other hand, ensures fully automatic operation without any parts having to be replaced. The setting of the spacing of the two belt drives 35, 36, the setting of the guide rail 48 and the setting of the sensor can be carried out without difficulty in a very short time.

I claim:

1. Device for cutting a wire binding portion for binding a sheet pack, comprising a casing over which is rotatably mounted a delivery spool with an endless wire strand shaped to form a wire binding, particularly a wire comb binding; measuring means, sensing means, and cutting means provided for cutting wire binding portions of given length from the wire strand; and a feed mechanism comprising an envelope drive is provided and including envelope member which is in frictional contact with the wire strand guided on a running path and moves therewith; wherein the envelope drive of the feed mechanism is constructed as a twin belt drive with two juxtaposed belt drives having envelope members which are circular profile belts, said belts having each an outside engaging on the wire strand.

2. Device according to claim 1, wherein an independent drive motor is provided for driving each the delivery spool and the feed mechanism.

3. Device according to claim 2, wherein the drive motor, for driving the delivery spool is switched on at intervals, the strand passing in a loop, which cooperates with a sensor of said sensing means and when the loop passes over said sensor said drive motor is switched on.

4. Device according to claim 1, wherein said measuring means includes a sensor associated with the feed mechanism for measuring a preset length of the wire binding portion to be separated by counting the bindings.

5. Device for cutting a wire binding portion for binding a sheet pack, comprising a casing over which is rotatably mounted a delivery spool with an endless wire strand shaped to form a wire binding, particularly a wire comb binding; measuring means, sensing means, and cutting means provided for cutting wire binding portions of given length from the wire strand; and a feed mechanism comprising an envelope drive is provided and including envelope member which is in frictional contact with the wire strand guided on a running path and moves therewith; wherein the envelope drive of the feed mechanism is constructed as a twin belt drive with two juxtaposed belt drives having envelope members which are circular profile belts, said belts having each an outside engaging on the wire strand; and wherein the belt drives have a lateral spacing which is adjustable.

6. Device for cutting a wire binding portion for binding a sheet pack, comprising a casing over which is rotatably mounted a delivery spool with an endless wire strand shaped to form a wire binding, particularly a wire comb binding; measuring means, sensing means, and cutting means provided for cutting wire binding portions of given length from the wire strand; and a feed mechanism comprising an envelope drive is provided and including envelope member which is in frictional contact with the wire strand guided on a running path and moves therewith; wherein the envelope drive of the feed mechanism is constructed as a twin belt drive with two juxtaposed belt drives having envelope members which are circular profile belts, said belts having each an outside engaging on the wire strand; and wherein the envelope drive is mounted in a bearing body displaceable at right angles to the running path and which is under the action of at least one spring, a tension action of which is directed against the running path.

7. Apparatus for cutting wire binding of various size, pitch and wire thickness into wire binding portions for binding sheets of paper, comprising:

(a) a deliver spool with an endless wire strand shaped to form a wire binding having a plurality of wire binding elements;

(b) measuring means for determining the length of the wire binding by counting individual wire binding elements;

(c) cutting means for cutting a wire binding portion having a given length from the wire binding; and (d) sensing means for detecting the discharge of the wire binding portion;

(e) a feed mechanism having a belt drive means for frictionally moving the wire binding forward on a running path, including at least a first and second wheel rotatably journalled on a shaft and being driven by a motor means with a belt around one of the wheels, the wheels being adjustably spaced at a predetermined distance for adapting the feed mechanism to wire binding having different sizes.

8. Apparatus for cutting wire binding according to claim 7, wherein the belt drive means further includes a third and fourth wheel rotatably journalled on a second shaft being driven by the motor means with the belt around the first and third wheels, and further wherein the first and second wheels, and the third and fourth wheels, are spaced at the predetermined distance which is adjustable for adapting the feed mechanism to wire binding having different dimensions.

9. Apparatus for cutting wire binding according to claim 7, wherein the wire binding enters the feed mechanism passing under the belt drive means, and a back surface of one one of the wheels is pressed onto an inside surface of the wire binding.

* * * * *